United States Patent [19]

Rotondo

[11] 4,392,461

[45] Jul. 12, 1983

[54] ROCKER ARM ADAPTER FOR ALTERING CAM PROFILE OF EXHAUST VALVE

[76] Inventor: Richard Rotondo, 3804 Highcrest Rd., St. Anthony Village, Minn. 55421

[21] Appl. No.: 205,728

[22] Filed: Nov. 10, 1980

[51] Int. Cl.[3] ..... F01L 1/34; F01L 1/24

[52] U.S. Cl. ..... 123/90.16; 123/90.46; 123/90.58

[58] Field of Search ..... 123/90.16, 90.39, 90.46, 123/90.47, 90.55, 90.58

[56] References Cited

U.S. PATENT DOCUMENTS

| | | | |
|---|---|---|---|
| 2,053,743 | 9/1936 | Russell | 123/90.46 |
| 2,404,241 | 7/1946 | MacMillan | 123/90.46 |
| 2,434,386 | 1/1948 | Bradshaw | 123/90.46 |
| 2,764,141 | 9/1956 | Schoonover | 123/90.47 |
| 2,827,028 | 3/1958 | Dadd | 123/90.47 |
| 2,833,257 | 5/1958 | Lengnick | 123/90.46 |
| 3,024,775 | 3/1962 | Wuest | 123/90.33 |
| 3,678,906 | 7/1972 | Repko et al. | 123/90.47 |
| 3,880,127 | 4/1975 | Abell, Jr. | 123/90.35 |
| 4,020,806 | 5/1977 | Aoyama et al. | 123/90.55 |
| 4,104,996 | 8/1978 | Hosono et al. | 123/90.43 |
| 4,192,263 | 3/1980 | Kitagawa et al. | 123/90.39 |

FOREIGN PATENT DOCUMENTS

| | | | |
|---|---|---|---|
| 165231 | 6/1921 | United Kingdom | 123/90.46 |

OTHER PUBLICATIONS

Angrist, S. W., "Fluid Control Devices", *Scientific American,* vol. 211, No. 6 (Dec. 1964), pp. 80–88.

*Primary Examiner*—Craig R. Feinberg
*Assistant Examiner*—W. R. Wolfe
*Attorney, Agent, or Firm*—Burd, Bartz & Gutenkauf

[57] ABSTRACT

A rocker arm (18) adapter for use in the timing mechanism of an internal combustion engine is disclosed. The adapter is a method for altering the cam (10) profile of the exhaust valve of the engine with respect to the intake valve. It includes a fluidic delay device (44) mounted in either the first end (22) or the second end (24) of the rocker arm (18). The delay device (44) includes a piston (46) which is allowed to move various distances in a cavity formed in the rocker arm (18), the distance being directly related to the speed of movement of a push rod member (16). As the speed of the engine, and the speed of movement of the push rod (16), increases, the piston (46) will be allowed to move a greater distance into the cavity so that the delay in actuation of the rocker arm (18) by the push rod (16) is increased.

16 Claims, 5 Drawing Figures

ROCKER ARM ADAPTER FOR ALTERING CAM PROFILE OF EXHAUST VALVE

TECHNICAL FIELD

The invention of the present application refers broadly to the field of mechanics of internal combustion engines. More specifically, however, it is concerned with components of the engine which generate the cam profile of the exhaust valve of an engine cylinder with respect to the profile of the intake valve. Narrowly, it is directed to apparatus for altering the cam profile of the exhaust valve varying amounts depending upon engine speed in order to effectuate more efficient and economic engine operation.

BACKGROUND OF PRIOR ART

Because of a number of factors, not the least important of which is the rising cost of gasoline, the development of automobiles which have engine components to accomplish efficient and economic use of gasoline fuel has become an urgent project of the world's technological community. Nor is there any indication that fuel costs will decline in the foreseeable future so as to reduce the importance of the development of inventions which effectuate more efficient combustion of the gasoline/air mixture fed into the engine cylinders.

In the four-stroke gasoline engine powering many automobiles, operation of the inlet and exhaust valves for each cylinder is coordinated with the position of the piston within the cylinder. During the first stroke of the piston, the induction stroke, the inlet valve is open so that an air/fuel mixture fed to the cylinder inlet from the carburetor via an intake manifold can be admitted into the cylinder. During the compression stroke the piston moves upwardly within the cylinder to compress the air/gas mixture. During this stroke, therefore, both the inlet and exhaust valves must be closed.

The third stroke, or power stroke, involves downward movement of the piston in response to combustion of the air/fuel mixture when it is ignited by a spark provided by a spark plug. Again, both valves must be closed in order to effectuate maximum downward force upon the piston. If one or both of the valves were open, the gases, while expanding, would, at least partially, be allowed to be vented through the open valve.

The exhaust stroke begins as the piston again begins upward movement within the cylinder. During this stroke, of course, the exhaust valve must be open so that the by-products of combustion can be vented therethrough. After venting of these by-products occurs, the exhaust valve closes and the inlet valve again opens in order to begin a new cycle.

Normally, the valves are biased to a closed position, and they are open according to a predetermined timing schedule. This timing is coordinated by a cam-push rod-rocker arm arrangement provided for each valve. As the cam rotates, it translates its rotary motion into axial motion of the push rod. The push rod, in turn, causes pivoting of the rocker arm to open the particular valve involved. Rotation of the cam is geared to rotation of a crank shaft common to all cylinders in the engine. The crank shaft is made to rotate by use of a connecting rod extending from the piston in each cylinder. Consequently, the up and down movement of the piston within the cylinder can be translated into appropriately timed opening and closing of the respective inlet and exhaust valves of the particular cylinder.

In some engines, the volume of the air/gasoline mixture introduced into the cylinders is dependent upon the speed of the engine and the particular mode of operation thereof. Specifically, if the engine is in a period of acceleration, the volume of gasoline being admitted to the cylinder will likely be greater than during a period of constant speed cruising, deceleration, or idling. If the cam profile has not been varied, the exhaust valve will open in accordance with the same timing schedule as it would during other modes of operation of the engine, and complete and efficient combustion of all of the air/gasoline mixture will not occur.

Technology has provided devices to cure this defect to some degree. Different methods have been invented to alter the cam profile so that the exhaust valve stays closed longer in order to effect more complete burning of the air and fuel. These devices are, however, mechanical means which delay the opening of the exhaust valve a fixed amount regardless of the speed and operational mode of the engine. Consequently, in certain modes of operation, complete and efficient combustion may have already occurred, and the exhaust valve has not yet opened. This also gives rise to less efficient operation of the engine.

Although valve opening and closing occurs at a high rate of speed, maximum engine efficiency is frequently not attained because of comparatively sluggish valve actuation. A high valve lift rate (that is, the speed of valve opening) can improve performance significantly over that obtained where valve lift rate is low.

It is to these problems in the art to which the invention of the present application is directed. It provides a structure which effectuates a delay in the opening of the exhaust valve so that the amount of delay is directly proportional to the engine speed. The delay is, in turn, directly proportional to the quantity of gasoline introduced into the cylinder. It, therefore, maximizes the efficiency of combustion regardless of the speed at which the engine operates and the richness of the air/fuel mixture.

SUMMARY OF THE INVENTION

The present invention is an adaptor for use with the rocker arm of valves of an internal combustion engine of the type typically used in an automobile. It has as an objective the altering of the cam profile of the exhaust valve of the cylinder of the engine with respect to that of the intake valve. It is capable of altering the profile varying amounts depending on the speed of the engine. Wherein the rocker arm is mounted in a see-saw manner for pivoting movement between first and second positions and wherein the rocker arm has a first end engaged by a push rod adapted for longitudinal movement in response to cam actuation, and a second end engaging a valve stem of the exhaust valve of the engine, and wherein the rocker arm, as it moves from its first to its second position, opens the valve by overcoming a bias urging the valve to its closed position, the invention includes a piston which is mounted for movement into and out of a cavity formed in either the first or second end of the rocker arm. That portion of the rocker arm which comprises the piston engages either the push rod or the valve stem, depending upon the end of the rocker arm in which the cavity is formed. The invention further includes means for precluding movement of the piston beyond certain defined positions which are dependent upon the speed with which the push rod longitudinally moves. When the cavity is formed in the first end of the rocker arm, that is, the end which is engaged by the push rod, movement of the push rod toward the rocker arm will, for a time, be absorbed as the piston moves into the cavity a predetermined distance. After further movement of the piston is prohibited, the longitudinal movement of the push rod will be translated into pivoting movement of the rocker arm. This pivoting movement will, in turn, effect opening of the exhaust valve of the cylinder. In an embodiment in which the cavity is formed in the second end of the rocker arm, the rocker arm will respond immediately to the longitudinal movement of the push rod toward the rocker arm. Opening of the valve will, however, be delayed since the piston, which in this embodiment engages the end of the valve stem, will be moved into the cavity by the resistance of the bias urging the valve closed. When movement of the piston becomes precluded, the valve will respond to the pivoting movement of the rocker arm and open.

In a preferred embodiment, the distance which the piston will be allowed to move into the cavity in response to the speed of the push rod includes a manifold member mounted in the cavity. The manifold member is fixedly mounted within the cavity to define an exterior chamber between one end of the member and the piston, and a plurality of variable volume interior chambers on the opposite side of the member. Each interior chamber has a maximum volume to which it can expand, and these maximums vary from chamber to chamber.

In this embodiment, the exterior chamber is filled with a fluid. Fluid communication is provided from the exterior chamber to each of the interior chambers by a passageway network provided through the manifold member. An inflow passageway communicates with the exterior chamber and divides into a plurality of outflow channels, each of these channels entering into a different one of the interior chambers.

Means are provided for channeling the bulk of fluid flow from the exterior chamber through the inflow passageway in response to piston movement, into a different one of the outflow channels depending upon the speed of the longitudinal movement of the push rod. When the speed of the push rod is great, fluid flow through the inflow passageway is directed to the outflow channel entering into that interior chamber having the greatest maximum volume to which any interior chamber can expand. As the longitudinal speed of movement of the push rod decreases, the bulk of fluid flow through the inflow passageway is redirected into an outflow channel which enters into an interior chamber having a maximum expansible volume smaller than that chamber into which the fluid flow empties at the higher rate of speed of the push rod. The bulk of flow through the inflow passageway is channeled into various other outflow channels entering into inner chambers having variable volumes expansible to maximum volumes progressively smaller as the speed of the push rod decreases even further.

This channeling of flow can be accomplished by providing a diversion passageway communicating at one end with the exterior chamber and in which fluid flow is induced by movement of the piston. The diversion passageway intersects at its opposite end with the inflow passageway, and this intersection is oblique with respect to a directional axis along which the inflow passageway is oriented. Thus, as the speed of fluid flow through the diversion passageway, which speed is directly proportional to the speed of movement of the push rod, increases, flow through the diversion passageway will effect a greater deflection of the fluid flow through the inflow passageway. The outflow channel which flows into the interior chamber having the greatest maximum volume can, therefore, be disposed with respect to the directional axis along which the inflow passageway is oriented so that there is a degree of angular variation therebetween commensurate with the amount of fluid flow deflection which occurs at a high speed of longitudinal movement of the push rod. At low speeds of push rod movement, flow through the inflow passageway may be diverted only slightly, or even not at all. The outflow channel entering into the interior chamber having the smallest maximum volume can, therefore, be oriented substantially along the directional axis of the inflow passageway. Other outflow channels can have a measure of angular variation from the directional axis of a measure somewhere between that of the two channels heretofore discussed.

The invention of this application is thus a rocker arm adapter which alters the cam profile varying amounts depending upon the speed of movement of the push rod. Specific advantages of the invention will become apparent with reference to the accompanying drawings, detailed description of the invention, and claims.

DESCRIPTION OF THE PREFERRED EMBODIMENT

Figure 1:
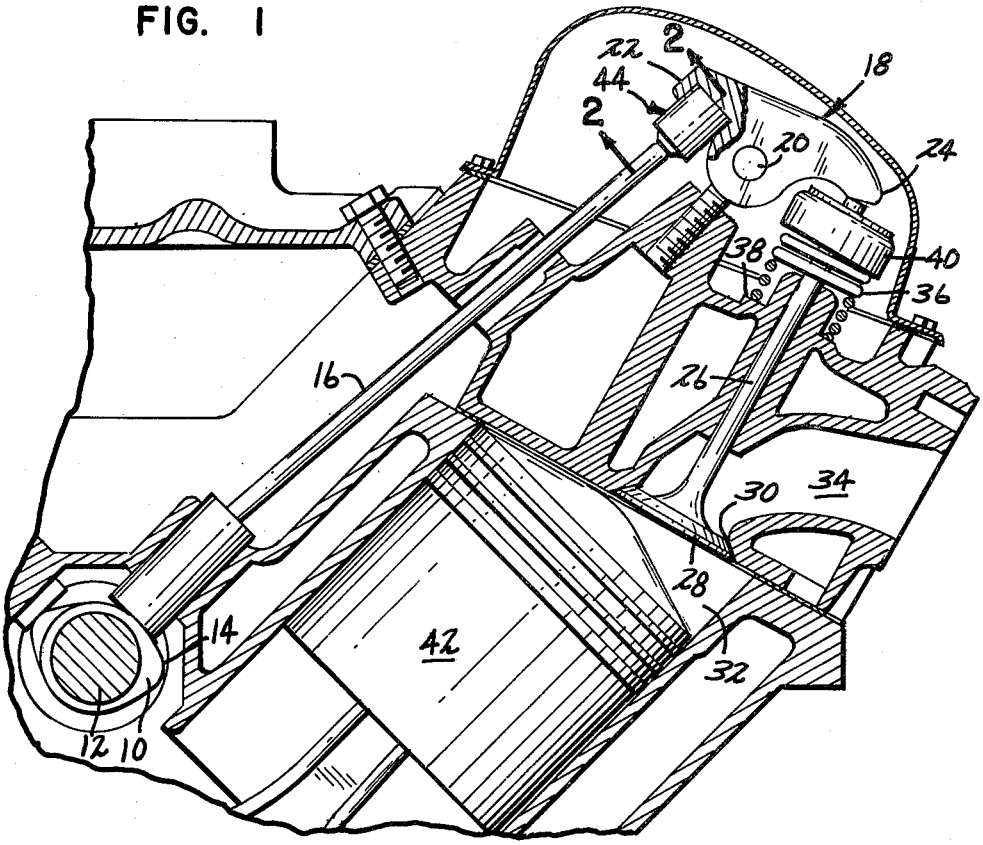
FIG. 1 is a side elevational view of the timing structure which effects opening and closing of an exhaust valve of an internal combustion engine.

Referring now to the drawings, wherein like reference numerals denote like elements throughout the several views, FIG. 1 illustrates a portion of the timing mechanism for a cylinder of an internal combustion engine as typically used in automobiles. The timing assembly includes a cam 10 mounted on a cam shaft 12 for rotation thereabout. The cam 10 has an eccentric peripheral surface 14 which is engaged by one end of a push rod member 16. As the cam shaft 12 rotates and the push rod 16 rides up the eccentric surface 14 of the cam 10, the rotational motion of the cam 10 is translated into longitudinal motion of the push rod 16.

A rocker arm 18 is pivotally mounted proximate an opposite end of the push rod 16. In FIG. 1, the rocker arm 18 is shown as being pivotally mounted for movement about a pivot 20 intermediate opposite first and second ends 22, 24 of the rocker arm 18. The rocker arm 18, thereby, pivots in a see-saw fashion.

A first end 22 of the rocker arm 18 is engaged by the second end of the push rod 16. As the push rod 16 moves longitudinally toward the rocker arm 18, it will cause the rocker arm 18 to move from a first position, which is the most counterclockwise position that the rocker arm 18 can assume, to a second position, which is the most clockwise position that the rocker arm 18 can assume.

The second end 24 of the rocker arm 18 engages the end of a valve stem 26. The valve stem 26 extends from a main valve portion 28 which occludes an exhaust port 30 providing agress from the cylinder 32 to an exhaust passageway 34. The valve is normally biased toward a closed position. Frequently this bias comprises a spring 36 engaging, at one end, a shoulder 38 on the engine block and, at the other end, a collar 40 attached to the valve stem 26.

FIG. 1 shows the valve in a closed position and the rocker arm 18 in its first position. As the cam 10 rotates in a direction clockwise as viewed in FIG. 1, the push rod 16 will move longitudinally upward and to the right and cause the rocker arm 18 to rotate in a clockwise direction to its second position. This will, in turn, cause the valve to be urged downwardly to its open position, overcoming the bias of the spring 36. This particular functioning will occur during the exhaust stroke of the piston 42 mounted for movement within the cylinder 32.

It is known that, during the operation of an automobile engine, sometimes in excess of 50% of the air/fuel mixture introduced into the cylinder for combustion is not effectively and efficiently burned. This problem can be remedied by delaying the opening of the exhaust valve so that the mixture can be combusted within the cylinder for a longer period of time. Various devices have sought to achieve a solution to the problem, but, in each case, the valve has been held closed only for a set period of time. Since the amount of combustible mixture introduced into the cylinder varies depending upon the mode of operation of the engine, the amount of delay in opening the valve should also vary in order to obtain most efficient operation.

A fluidic delay device, generally indicated at 44, made in accordance with the present invention effectuates this variable delay. Such a device is shown, in FIG. 1, formed in the first end 22 of the rocker arm 18. It will be understood, however, by those of skill in the art, that such a fluidic delay device 44 could just as appropriately be formed in the second end 24 of the rocker arm 18.

The device 44 includes a piston 46 which is disposed within a cavity formed in one of the ends of the rocker arm 18. The piston 46 can include a push rod engagement face 48 which is engaged by the end of the push rod 16. In embodiments wherein the device is formed in the second end 24 of the rocker arm 18, this face 48 of the piston 46 would engage the end of the valve stem 26.

Figure 2:
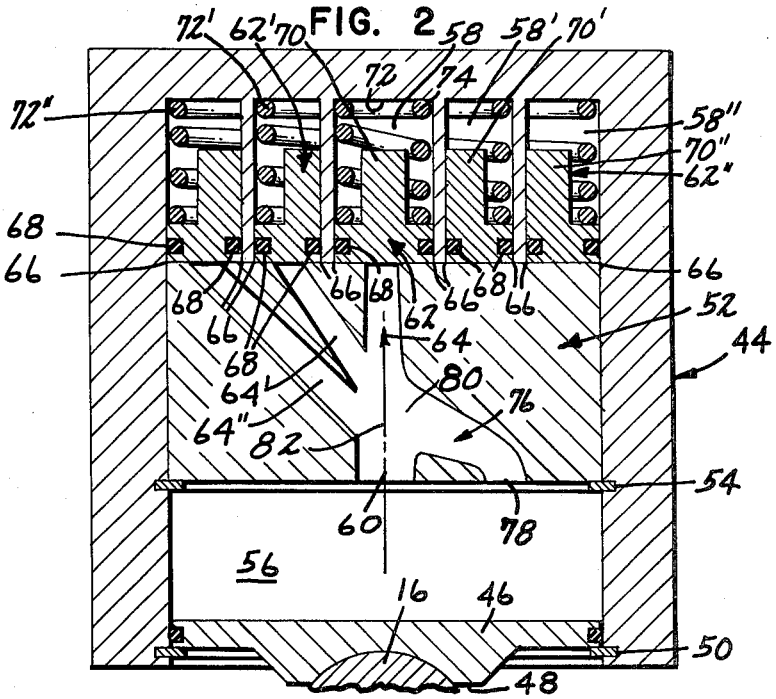
FIG. 2 is a view taken substantially along the line 2—2 of FIG. 1 showing the piston withdrawn substantially to the entrance to the fluidic delay device cavity.

Referring now to FIG. 2, the interior of the cavity formed in the rocker arm 18 is illustrated. The piston 46 is disposed for movement into and out of the cavity. Positive means such as a retaining ring 50 are provided to preclude complete withdrawal of the piston 46 from the cavity.

Mounted at a fixed location generally centrally within the cavity is a manifold member 52. This member may also be maintained in a fixed axial position within the cavity by means of a retaining ring or rings 54.

An exterior chamber 56 is defined between the manifold member 52 and the piston 46. An interior chamber is defined between the opposite end of the member 52 and the inner end of the cavity. This interior chamber is, in turn, subdivided into a plurality of smaller interior chambers (58, 58′, 58″). FIG. 2 shows a cavity which is circularly cylindrical in cross-section, and the interior chambers comprise a small circularly cylindrical chamber 58 centrally positioned within the cavity and two small annular interior chambers 58′, 58″ concentrically encircling the centrally positioned one.

Since each interior chamber has a similar axial length, the volumes of the chambers increase in a radially outward direction since each successive radially outward chamber has a larger cross-sectional area than does the chamber immediately radially inward 58.

The exterior chamber 56 is filled with a fluid, and fluid communication is provided between that chamber 56 and the interior chambers 58, 58′, 58″ through the manifold element 52. An inflow passageway 60 provides egress for the fluid from the exterior chamber 56. The inflow passageway 60, thereafter, divides into a plurality of outflow channels 64, 64′, 64″, the number of channels being the same as the number of interior chambers 58, 58′, 58″.

Each interior chamber 58, 58′, 58″ can include means for normally maintaining said chambers empty. In one embodiment, these means can take the form of a piston 62, 62′, 62″ mounted within each chamber, which piston is biased to occlude a second end of the outflow channel 64, 64′, 64″ which empties into the respective interior chamber 58, 58′ 58″. Radial edges 66 of the pistons 62, 62′, 62″ can be sealed such as by use of O-rings 68 so that fluid caused to be passed through the manifold member 52 will exert force on the face of the pistons 62, 62′, 62″ rather than leaking around the edges.

Similarly, the piston 46 disposed in the exterior chamber 56 can be sealed to preclude leakage of the fluid out of the cavity.

The fluid delay device 44 further includes means for precluding movement of the piston 46 operably disposed within the exterior chamber 56 beyond various positions within this chamber. Movement of the piston 46 can be precluded by preventing the volumetric expansion of the various interior chambers 58, 58′, 58″ beyond a certain volume as fluid in the exterior chamber 56 is forced through the manifold member 52 and into the various interior chambers 58, 58′, 58″. One way in which this can be accomplished is by providing a stop portion 70, 70′, 70″ on each piston disposed within the interior chambers so that each interior chamber cannot expand beyond a desired capacity. As each piston 62, 62′, 62″ is moved by the inflow of fluid through the outflow channels 64, 64′ 64″ and the volume of a chamber expands, the stop portion 70, 70′, 70″ attached to each piston engages the base 72 of the interior chamber to preclude further expansion.

At this point is should be pointed out that the bias of the spring 36 urging the valve to its closed position must exceed the bias of an individual spring 74, 74′, 74″ urging each piston 62, 62′, 62″ operatively disposed within an interior chamber to a position adjacent the manifold member 52. If the reverse were true, the motion of the push rod 16 would not be absorbed by the fluidic delay device, and the valve movement would directly correspond to the movement of the push rod 16. Since, however, the relative biases are as stated, the device will function to delay opening of the valve even as the push rod 16 moves longitudinally.

The aggregate biasing effect of two of the springs 74, 74', 74" within the interior chambers 58, 58', 58" should, however, exceed the biasing effect of the spring 36 urging the valve to its closed position. This should be the relative relationship so that, as one of the pistons 62, 62', 62" within an interior chamber 58, 58', 58" moves to allow expansion of the chamber to its maximum, the spring 36 biasing the valve to its closed position will not be capable of resisting the force tending to urge the rocker arm 18 to its second position since the fluid within the delay device 44 would then be working to overcome the bias of the second spring in addition to the first. Consequently, as movement of the push rod 16 causes the piston 46 disposed in the exterior chamber 56 to force fluid into the inflow passageway 60 and into primarily one of the interior chambers 58, 58', 58" by a method to be described hereinafter, the force biasing the piston 62, 62', 62" in that particular chamber to a position adjacent the manifold member 52 will be overcome and the piston 62, 62', 62" will move. As the interior chamber 58, 58', 58" expands to its maximum volume, further movement of that particular piston 62, 62', 62" will be precluded and fluid flow will tend to be diverted into another one of the overflow channels 74, 74', 74". Since the fluid flow would then be directed to overcoming the bias of two of the interior chamber springs 74, 74', 74", the least resistance would be encountered at the spring 36 biasing the valve to its closed position, and further movement of the piston 46 in the exterior chamber 56 would be precluded. Pivoting motion would then be imparted to the rocker arm 18, and the valve would be opened.

In order that fluid flow through the inflow passageway 60 can be directed automatically to a desired outflow channel 64, 64', 64" in response to the speed of longitudinal movement of the push rod 16, a diversion passageway 76 can be provided. This passageway 76 can communicate at one end 78 with the exterior chamber 56 so that, as with the main inflow passageway 60, fluid flow is induced therein as movement is imparted to the piston 46 in the exterior chamber 56 by the push rod 16. At its second end 80, the diversion passageway 76 can be made to obliquely intersect the main inflow passageway 60. With this structuring, fluid flow through both of the passageways 60, 76 will increase directly as the speed of longitudinal movement of the push rod 16 increases.

The inflow passageway is oriented along a directional axis 82. As the flow of fluid through the inflow passageway 60 is struck by the flow through the deflection passageway 76, deflection of the main flow will occur.

Figure 3:
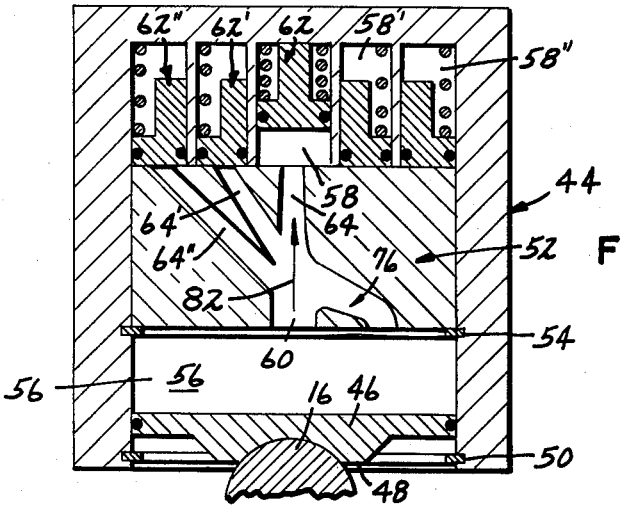
FIG. 3 is a view similar to FIG. 2 wherein fluid flow through the inflow passageway is substantially undiverted by the obliquely intersecting fluid flow through the diversion passageway and has entered into an interior chamber having a relatively small, maximum expansible volume.
Figure 4:
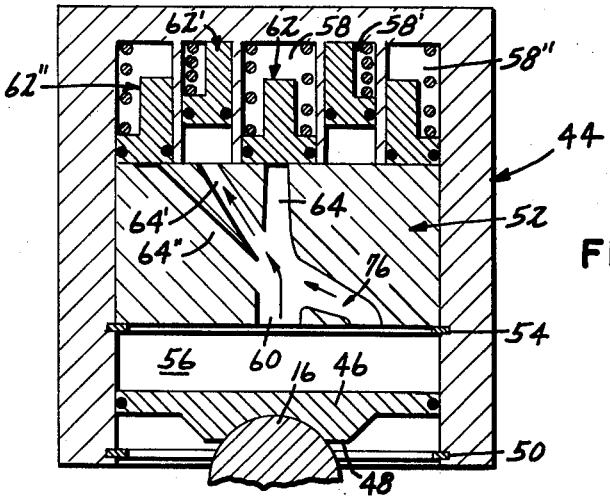
FIG. 4 is a view similar to FIG. 2 where the bulk of fluid flow through the inflow passageway is somewhat diverted into an interior chamber having a maximum expansible volume somewhat greater than the interior chamber into which flow enters in FIG. 3.
Figure 5:
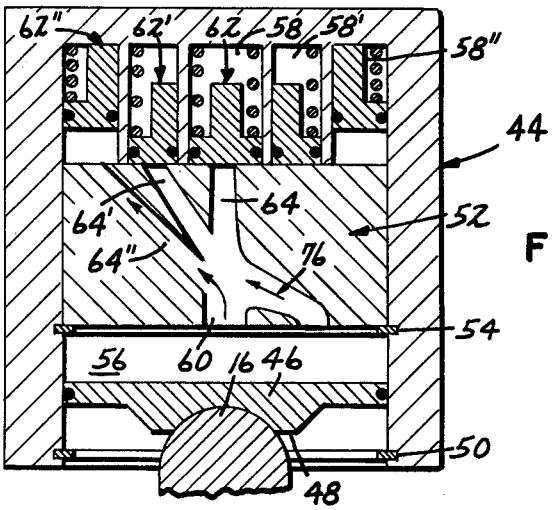
FIG. 5 is a view similar to FIG. 2 in which the bulk of fluid flow through the inflow passageway is diverted to enter an interior chamber having the greatest maximum expansible volume.

Referring now to FIGS. 3, 4, and 5, when the speed of the push rod 16 is low, fluid flow rates through both the inflow passageway 60 and the diversion passageway 76 are also low, and the main flow will continue substantially undiverted. One of the outflow channels 64 can, therefore, be oriented substantially along the directional axis 82 along which the inflow passageway is oriented.

As the speed of the push rod 16 increases, the rates of flow through both the passageways 60, 76 will also increase, and the force obliquely applied to the main flow by the flow through the diversion passageway 76 will cause some measure of angular diversion of the flow. An outflow channel 64' can be provided to channel the flow to another of the interior chambers 58'. This is illustrated in FIG. 4.

When the speed of the push rod 16 increases even further, so will the rates of flow through the inflow passageway 60 and the diversion passageway 76. The diversion flow will, therefore, cause an even greater oblique force to be applied to the main flow, and the greatest angular diversion of the main flow will occur. A third outflow channel 64" can be provided to conduct the fluid flow to another interior chamber 58". This is illustrated in FIG. 5.

In FIG. 3, wherein the speed of the push rod 16 is lowest, fluid flow is channeled to the interior chamber 58 having the smallest of the maximum volumes to which any of the chambers 58, 58', 58" can expand. As the speed of the push rod 16 and rates of flow through the passageways 60, 76 increase, flow will be channeled to an interior chamber 58' having a somewhat larger maximum expansible volume so that pivoting of the rocker arm 18 will be delayed somewhat longer. When the speed of the push rod 16 and the fluid flow rates through the passageways 60, 76 are greatest, fluid flow deflection will be greatest, and the flow will be channeled to the interior chamber 58" having the greatest maximum expansible volume. Consequently, actuation of pivoting movement of the rocker arm 18 will be delayed the longest in this instance. FIGS. 3, 4, and 5 illustrate the maximum movement of the piston 46 disposed in the exterior chamber 56, axially with respect to the cavity, in these three discussed instances. It can be observed, therefore, that, as the speed of push rod 16 and fluid flow rate through the passageways 60, 76 increase, the piston 46 will be allowed to move a greater axial distance into the exterior chamber 56.

In order to increase the response rate once the desired delay has been accomplished, a relatively incompressible fluid can be used. The delay will, thereby, be effected by the diversion of fluid flow into interior chambers 58, 58', 58" having different maximum expansible volumes rather than by compression of the fluid. Another factor which bears on the selection of the fluid to be used is the ability to accomplish desired deflection of the main fluid flow by the diversion flow.

As will be apparent to one of skill in the art, the arrangement hereinbefore described has other advantages. In addition to effectuating a desired delay in the opening of valves, it also causes the interior chambers 58, 58', 58" to be emptied of fluid as the push rod withdraws so that the proper delay can be again imposed during subsequent exhaust strokes of the cylinders' piston 42.

Additionally, so structuring the fluidic delay device 44 will increase the valve lift rate so that an exhaust valve will open sharply, allow the combustion products to be exhausted, and close again sharply prior to allowing intake of more air/fuel mixture during the next stroke of the cylinder. This is so both because of the bias of the springs 74, 74', 74" within the interior chambers 58, 58', 58" and because of some measure of compressibility in the fluid.

Numerous characteristics and advantages of the invention have been set forth in this detailed description. It will be understood, of course, that this disclosure is only illustrative. Changes may be made in many respects, particularly in matters of shape, size, and arrangement of parts without exceeding the scope of the invention. The invention's scope is defined in the language of the appended claims.

What is claimed is:

1. In combination with a rocker arm having first and second ends and mounted for pivoting movement between first and second positions and about a pivot intermediate the ends, wherein the second end engages a valve stem of a valve of an automobile engine and the rocker arm overcomes a bias urging the valve to a closed position and opens the valve as it moves from its first position to its second position, and a push rod engaging the first end to pivot the rocker arm from its first to its second position as the push rod moves longitudinally; a fluidic delay device, comprising means formed in the rocker arm at one end thereof, said means including a piston disposed for movement into and out of a cavity formed in said one end and engaged by one of the valve stem and push rod, and means for precluding movement of said piston into said cavity beyond various positions, wherein said piston moves into said cavity to different of said positions, depending upon the speed of longitudinal movement of the push rod, as the rocker arm is urged from its first position to its second position, said means for precluding movement of said piston comprising a manifold member mounted in said cavity to define an exterior chamber in which said piston moves, and a plurality of interior chambers having different volumes, said member having formed therethrough an inflow passageway communicating with said exterior chamber and dividing into a plurality of outflow channels, each of said channels entering into a different of said interior chambers; a fluid filling said exterior chamber, said inflow passageway, said outflow channels, and said interior chambers; and means responsive to said speed of longitudinal movement of the push rod for channeling the bulk of fluid flow in said inflow passageway induced by movement of said piston into said exterior chamber, into a different of said outflow channels.

2. The combination of claim 1 wherein said interior chambers have variable volumes expansible to different maximums and wherein the bulk of fluid flow is channeled into said outflow channel entering into one of said inner chambers having a variable volume exapansible to the greatest maximum volume when said speed of longitudinal movement of the push rod is greatest, and wherein the bulk of flow is channeled into outflow channels entering into the inner chambers having variable volumes expansible to maximum volumes progressively smaller as said speed of longitudinal movement of the push rod decreases.

3. The combination of claim 2 wherein said inflow passageway is oriented along a directional axis, said outflow channel entering said interior chamber having the variable volume expansible to the smallest maximum volume is oriented along said axis, and said other outflow channels diverge from said axis with said channel entering into said interior chamber having the variable volume expansible to the greatest maximum volume having the greatest measure of divergence, and wherein said channeling means responsive to movement of the push rod comprises a diversion passageway communicating with said exterior chamber and obliquely intersecting said inflow passageway so that fluid flow induced through said diversion passageway in response to movement of said piston into said cavity diverts the bulk of fluid flow similarly induced through said inflow passageway into one of said outflow channels with the measure of diversion increasing as the rate of fluid flow through said diversion passageway increases.

4. The combination of claim 3 wherein said fluid is liquid.

5. Apparatus for altering the cam profile of a first valve of a cylinder of an internal combustion engine, with respect to a second valve of the same cylinder, comprising: a rocker arm having first and second ends and being pivotally mounted for movement about a pivot intermediate said ends, and between first and second positions, said second end engaging a valve stem of the first valve with the first valve being closed when said rocker arm is in said first position and open when said rocker arm is in said second position; means for biasing said rocker arm to said first position; a push rod having an end engaging said first end of said rocker arm, and an opposite end; an eccentric cam mounted for rotation about an axis and having a peripheral surface engaging said opposite end of said push rod to impart longitudinal movement thereto as said cam rotates; and delaying means formed in said first end of said rocker arm engaged by said push rod for delaying movement of said rocker arm from said first position to said second position for different increments of time depending on the speed of rotation of said cam, as said cam rotates about said axis, said delaying means includes a cavity, having inner and outer ends, formed in said first end of said rocker arm, said cavity having mounted therein a fluidic device comprising a manifold member mounted in said cavity intermediate said inner and outer ends to define an interior chamber and an exterior chamber, said interior chamber comprising a plurality of smaller interior chambers each having a different volume into which a fluid can flow, said manifold member having an inflow passageway oriented along a directional axis and a diversion passageway obliquely intersecting said inflow passageway, both communicating with said exterior chamber, and a plurality of outflow channels communicating, at first ends, with said inflow passageway, and, at second ends, with one of said interior chambers; wherein a first of said outflow channels continues substantially along said directional axis of said inflow passage into a first of said interior chambers which has the smallest fluid admission volume, a second of said outflow channels has a measure of angular diversion with respect to said directional axis and communicates with a second of said interior chambers having a larger fluid admission volume than that of said first interior chamber, and a third of said outflow channels has the greatest measure of angular diversion with respect to said directional axis and communicates with a third of said interior chambers having a larger fluid admission volume than that of said second interior chamber; a piston mounted for sliding movement in said exterior chamber and having a push rod engagement face engaged by said push rod engaging end and a fluid engagement face; and a fluid filling said interior chambers and said exterior chamber, said inflow passage, said diversion passage, and said outflow channels.

6. Apparatus in accordance with claim 5 wherein said fluid is liquid.

7. Apparatus in accordance with claim 6 further comprising means for emptying said interior chambers of said fluid through said outflow channels, said inflow passage, and said diversion passage formed in said manifold member, when said cam rotates to effect longitudinal movement of said push rod in a direction away from said rocker arm.

8. Apparatus in accordance with claim 7 wherein said emptying means comprises:

(a) a piston mounted in each of said interior chambers for movement away from said second end of said outflow channel as said fluid flows into said each interior chamber and toward said second end as said each interior chamber is emptied; and (b) means biasing each of said pistons toward said second end of said outflow channel which communicates with said each interior chamber in which said piston is disposed.

9. An apparatus for altering the operation of a valve of an internal combustion engine, said valve being movable between open and closed positions with valve operating means comprising: delaying means associated with the valve operating means for delaying movement of the valve from the closed position to the open position in response to the speed of operation of the internal combustion engine, said delaying means including means having a cavity, manifold means mounted in said cavity to define an interior chamber and an exterior chamber, said interior chamber comprising a plurality of chambers, each of said plurality of chambers having a different volume into which fluid can flow, said manifold means having inflow passage means and diversion passage means obliquely intersecting the inflow passage means, said inflow passage means and diversion passage means communicating with said exterior chamber, and a plurality of outflow channels open to the inflow passage means and the plurality of chambers, means for emptying said plurality of chambers of said fluid in response to closing movement of said valve, said fluid filling said interior chamber, exterior chamber, inflow passage means, diversion passage means, and outflow channels, and piston means mounted for sliding movement in the exterior chamber, said piston means being movable in response to operation of the valve operating means to increase the pressure of the fluid causing the fluid to flow in said inflow and diversion passage means and outflow channels.

10. The apparatus of claim 9 wherein: said fluid is liquid.

11. The apparatus of claim 9 wherein: said means for emptying said plurality of chambers includes a piston mounted in each of said chambers for movement away from said manifold means in response to flow of fluid into each of said plurality of chambers and means biasing each of said pistons toward said manifold means.

12. The apparatus of claim 11 wherein: one of said pistons is a circular piston and the remaining pistons are annular pistons concentrically located about said circular piston.

13. A fluidic device comprising: means having a cavity, manifold means mounted in said cavity to define an interior chamber and an exterior chamber, said interior chamber comprising a plurality of chambers, each of said plurality of chambers having a different volume into which fluid can flow, said manifold means having inflow passage means and diversion passage means obliquely intersecting the inflow passage means, said inflow passage means and diversion passage means communicating with said exterior chamber, and a plurality of outflow channels open to the inflow passage means and the plurality of chambers, a fluid filling said interior chamber, exterior chamber, inflow passage means, diversion passage means, and outflow channels, means for emptying said plurality of chambers including a piston mounted in each of said plurality of chambers for movement away from said manifold means in response to flow of fluid into the plurality of chambers, one of said pistons being a circular piston and the remaining pistons are annular pistons concentrically located about said circular piston, means biasing each of said pistons toward said manifold means, and piston means mounted for sliding movement in the exterior chamber.

14. The device of claim 13 wherein: said fluid is liquid.

15. The device of claim 13 wherein: each of said pistons have stop means limiting movement of the pistons away from the manifold means.

16. The device of claim 13 wherein: said means biasing each of said pistons comprise coil springs located in said plurality of chambers.

* * * * *

UNITED STATES PATENT AND TRADEMARK OFFICE

CERTIFICATE OF CORRECTION

PATENT NO. : 4,392,461

DATED : July 12, 1983

INVENTOR(S) : Richard D. Rotondo

It is certified that error appears in the above-identified patent and that said Letters Patent is hereby corrected as shown below:

Column 2, lines 41 and 42, "f-uel" should be -- fuel --.

Column 5, line 16, "agress" should be -- egress --.

Column 6, line 62, "is" should be -- it --.

Column 7, line 29, "overflow" should be -- outflow --.

Signed and Sealed this

*Eleventh* Day of *October 1983*

[SEAL]

*Attest:*

GERALD J. MOSSINGHOFF

*Attesting Officer*

*Commissioner of Patents and Trademarks*